US008027607B2

(12) United States Patent
Kurata et al.

(10) Patent No.: US 8,027,607 B2
(45) Date of Patent: Sep. 27, 2011

(54) IMAGE FORMING APPARATUS

(75) Inventors: Munehito Kurata, Mishima (JP); Daizo Fukuzawa, Mishima (JP); Mahito Yoshioka, Numazu (JP); Noriaki Sato, Suntou-gun (JP); Tooru Imaizumi, Kawasaki (JP); Kuniaki Kasuga, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 413 days.

(21) Appl. No.: 12/366,023

(22) Filed: Feb. 5, 2009

(65) Prior Publication Data

US 2009/0202266 A1 Aug. 13, 2009

(30) Foreign Application Priority Data

Feb. 8, 2008 (JP) ..... 2008-028770

(51) Int. Cl.
*G03G 15/20* (2006.01)

(52) U.S. Cl. ..... 399/69

(58) Field of Classification Search ..... 399/67, 399/68, 69

See application file for complete search history.

(56) References Cited

U.S. PATENT DOCUMENTS

| | | | | |
|---|---|---|---|---|
| 5,365,314 | A | 11/1994 | Okuda et al. | 355/208 |
| 5,444,521 | A | 8/1995 | Tomoyuki et al. | 355/285 |
| 5,464,964 | A | 11/1995 | Okuda et al. | 219/497 |
| 5,552,582 | A | 9/1996 | Abe et al. | 219/619 |
| 5,669,039 | A | 9/1997 | Ohtsuka et al. | 399/68 |
| 5,697,037 | A | 12/1997 | Yano et al. | 399/333 |
| 5,801,360 | A | 9/1998 | Oba et al. | 219/216 |
| 5,862,436 | A * | 1/1999 | Ishizawa et al. | 399/69 |
| 5,915,146 | A | 6/1999 | Kusaka et al. | 399/69 |
| 6,151,462 | A | 11/2000 | Fukuzawa et al. | 399/68 |
| 6,175,699 | B1 | 1/2001 | Kato et al. | 399/67 |
| 6,366,745 | B1 | 4/2002 | Adachi et al. | 399/69 |
| 7,283,763 | B2 * | 10/2007 | Akizuki et al. | 399/68 |
| 2004/0131374 | A1 * | 7/2004 | Sakai | 399/69 |

FOREIGN PATENT DOCUMENTS

| | | |
|---|---|---|
| JP | 5-135848 | 6/1993 |
| JP | 2002-169413 | 6/2002 |
| JP | 2006-154061 | 6/2006 |
| JP | 2007-272031 | 10/2007 |

* cited by examiner

*Primary Examiner* — Matthew Luu
*Assistant Examiner* — Frederick Wenderoth
(74) *Attorney, Agent, or Firm* — Fitzpatrick, Cella, Harper & Scinto

(57) ABSTRACT

The image forming apparatus, in the case where image forming is performed on a recording medium whose size covers a position of a second temperature detection element perpendicularly disposed to the recording medium conveyance direction, when the detected temperature rises to a predetermined temperature during execution of the first power supply control, a first power supply control is switched to a second power supply control. In the case where image forming is performed on a recording medium whose size does not cover a position of the second temperature detection element, when the detected temperature rises to a predetermined temperature during execution of the first power supply control, a conveyance control portion executes a control for extending the conveyance interval of the recording medium. Thus, an unduly large temperature rise in the non-sheet passing portion is prevented, and a good quality image can be provided without glossy unevenness in one sheet.

3 Claims, 6 Drawing Sheets

IMAGE FORMING APPARATUS

BACKGROUND OF THE INVENTION

1. Field of the Invention

The present invention relates to an image forming apparatus using an electrophotographic process, such as a printer, a copying machine, and a facsimile machine.

2. Description of the Related Art

In some fixing apparatuses used in image forming apparatuses to fix an unfixed toner image (or unfixed developer image) borne on a recording medium by applying heat thereto to form a permanent fixed image, use is made of a heat roller type fixing system including a fixing member provided with an elastic layer. However, in the heat roller type fixing system having an elastic layer, the heat capacity of the heat roller itself tends to be large. For this reason, it has a drawback that a time required to raise the temperature of the fixing member to a temperature adequate to fix a toner image is long. (The time required to raise the temperature of the fixing member to an adequate temperature will be hereinafter referred to as "warm-up time".)

In view of the above, in recent years, fixing apparatuses using a film heating system, in which the heat capacity of a fixing member is small, have been increasingly used. In the fixing apparatus using a film heating system, a heat resistant film (which will be referred to as a fixing sleeve or an endless belt) is pinched between a ceramic heater serving as a heat member and a pressure roller serving as a pressurizing member to form a fixing nip portion. In this fixing nip portion, a recording medium on which an unfixed toner image has been formed and borne is introduced between the fixing sleeve and the pressure roller, and the recording medium is pinched and conveyed together with the fixing sleeve. Thus, in the fixing nip portion, heat of the ceramic heater is transferred to the recording medium via the fixing sleeve, whereby the unfixed toner image is fixed as a permanent fixed image on the recording medium with an aid of the pressurizing force in the fixing nip portion. In the case of the above-described fixing apparatus using a film heating system, the heat capacity of the fixing sleeve that serves as the fixing member is small, and therefore the warm-up time can be made shorter. On the other hand, however, the fixing apparatus using a film heating system encounters a problem in terms of heat conduction in the direction (which will be hereinafter referred to as the longitudinal direction) perpendicular to the direction of conveyance of the recording medium, and the non-sheet passing portion temperature rise that will be described later will occur in this system.

Specifically, the heater or the heat member has an electrified heat generation resistive layer extending along the longitudinal direction. The electrified heat generation resistive layer is electrified (i.e. supplied with electrical power) through the electrodes provided at the ends thereof, whereby it generates a specific quantity of heat per unit length. The length of the electrified heat generation resistive layer along the longitudinal direction is designed to be large enough to enable fixation of the end or edge portions of a recording medium having the maximum width that can be supplied to (or passed through) the image forming apparatus. Thus, the electrified heat generation resistive layer generates heat throughout its entire length along the longitudinal direction irrespective of the width of recording mediums that are passed. For example, in the case of an image forming apparatus in which the maximum width size of the usable recording mediums is the letter size width (LTR width), when a recording medium having a width not larger than A4 size, which is smaller than letter size, passes, the following situation will occur. That is, heat will accumulate in the area outside the recording medium passing area (which outside area will be hereinafter referred to as the "non-sheet passing portion"), since removal of heat energy by the recording medium will not occur in the non-sheet passing portion. This phenomenon is the non-sheet passing portion temperature rise.

In recent years, with increases in the speed of operation of the image forming apparatus, the recording sheet conveying speed in the fixing apparatus has become very high. Therefore, the temperature of the heater serving as a heat member is very high in order to give heat to the recording medium to ensure fixability of the toner image on the recording medium. Consequently, the non-sheet passing portion temperature rise is more likely to occur.

If the temperature rise in the non-sheet passing portion is large, so-called high temperature offset image errors occur in some cases. In addition, the fixing sleeve may be thermally affected, and there arise problems such as deterioration of durability thereof in some cases.

In view of the above, according to a widely known method, when the temperature of the non-sheet passing portion reaches a predetermined temperature, the printing operation is suspended for a certain period of time until the temperature of the non-sheet passing portion falls. According to another method, when recording mediums are supplied or conveyed successively, the interval between the trailing edge of a preceding recording medium and the leading edge of the succeeding recording medium is extended to reduce the temperature rise in the non-sheet passing portion. However, these methods are disadvantageous in that the throughput (i.e. the number of sheets processed in the image formation process per unit time) is greatly decreased, which leads to a decrease in the productivity.

Japanese Patent Application Laid-Open No. H05-135848 discloses a fixing apparatus having features described in the following. In this apparatus, a plurality of temperature detection elements are provided along the longitudinal direction of a heater. At least one of the temperature detection elements is a first temperature detection element provided in the area in which recording mediums of all the sizes pass, and at least one other temperature detection element is a second temperature detection element provided in an area that becomes a non-sheet passing portion when recording mediums having a certain size(s) pass. When a small size sheet, or a recording medium having a size that does not extend to the position at which the second temperature detection element is provided, is supplied, power supply to the heater is controlled normally so that the output value of the first temperature detection element is kept constant. When it is detected that the temperature detected by the second temperature detection element or the temperature at the non-sheet passing portion reaches a predetermined temperature while power supply to the heater is controlled so that the output value of the first temperature detection element is kept constant, the control is switched into a control for keeping the output value of the second temperature detection element constant. The fixing apparatus disclosed in this document can prevent an unduly large temperature rise in the non-sheet passing portion by the above-described control.

The above described prior art system is advantageous in that an unduly large temperature rise in the non-sheet passing portion of the heater can be prevented by switching the power supply control into the control for keeping the output value of the second temperature detection element constant, when the second temperature detection element disposed at a position in the non-sheet passing portion detects that a predetermined temperature is reached.

However, the control for keeping the temperature in the non-sheet passing portion constant ha the following disadvantage in some cases.

As is the case with the above described prior art, power supply to the heater is normally controlled so that the output value of a temperature detection element provided in the central portion of the recording medium passing area with respect to the longitudinal direction (i.e. the first temperature detection element) is kept constant. In this case, in the time period during which a recording medium is passing through the fixing nip portion (which will be hereinafter described as "during sheet passing"), the power supplied to the heater is made large, because heat is removed by the recording medium. On the other hand, in the time period after a preceding recording medium has left the fixing nip portion and before the succeeding recording medium enters the fixing nip portion (which will be hereinafter described as "during sheet interval), removal of heat by the recording medium does not occur. For this reason, in a case where a control for keeping the temperature constant is performed, the power supplied to the heater during sheet interval is controlled to be smaller than that during sheet passing. In this case, if recording mediums pass successively, the temperature at the non-sheet passing portion, in which heat is not removed by the recording medium at any time, rises steeply during sheet passing during which a large power is supplied, and falls, conversely, during sheet interval during which the supplied power is made smaller. FIG. 8 schematically illustrates the temperature at the central portion of the sheet passing area, the temperature at the non-sheet passing portion, and the power supplied or input to the heater in such a case. FIG. 8 schematically illustrates the temperature at the central portion of the sheet passing area (or the temperature at the sheet passing portion) by the solid line, the temperature at the non-sheet passing portion by the broken line, and the input power (or the input power ratio) by the alternate long and short dashed line, in a case where a control for keeping the temperature of the sheet passing portion constant is performed (during successive sheet passing).

The magnitude of such changes in the temperature at the non-sheet passing portion increases with increases in the heat capacity, basis weight and thickness of the recording medium.

In a case where power supply to the heater is controlled so that the temperature at the non-sheet passing portion is kept constant when the temperature at the non-sheet passing portion has risen to a predetermined temperature, the temperature at a portion in the sheet passing area will behave as follows. In contrast with the case where power supply to the heater is controlled so that the temperature at a portion in the sheet passing area is kept constant, the temperature at the sheet passing portion decreases abruptly during sheet passing, because heat is removed by the recording medium. FIG. 9 schematically illustrates the temperature at the sheet passing portion, the temperature at the non-sheet passing portion, and the power supplied or input to the heater in relation to the number of passing sheets, in a case where a control for keeping the temperature at the non-sheet passing portion constant is performed. FIG. 9 schematically illustrates the temperature at the sheet passing portion by the solid line, the temperature at the non-sheet passing portion by the broken line, and the input power (or the input power ratio) by the alternate long and short dashed line, in a case where a control for keeping the temperature at the non-sheet passing portion constant is performed after the timing indicated by X. As will be understood from the temperature at the sheet passing portion indicated by arrows in the left portion of FIG. 9, the quantity of heat given to a sheet of the recording medium is larger toward leading edge of the recording medium and smaller toward the trailing edge thereof. Thus, the temperature falls as the sheet passes. Consequently, in one sheet of recording medium, the glossiness of the image may decrease toward the trailing edge, and the fixability of the image may decrease toward the trailing edge.

SUMMARY OF THE INVENTION

The present invention has been made in view of the above described problems and has as an object to provide an image forming apparatus in which an unduly large temperature rise in the non-sheet passing portion is prevented and that can provide good quality images without glossy unevenness or other defects in one sheet of recording medium.

An image forming apparatus for forming an image on a recording medium, comprising:

an image forming portion that forms an image on the recording medium;

a fixing portion that heats the image formed on the recording medium to fix the image on the recording medium, the fixing portion including an endless belt that is in contact with the recording medium, a heater that is in contact with an inner circumferential surface of said endless belt, a back-up member that forms, in cooperation with said heater, a fixing nip portion that pinches and conveys the recording medium via said endless belt, a first temperature detection element that detects a temperature of said heater or a temperature of said endless belt, a second temperature detection element that detects a temperature of said heater or a temperature of said endless belt at a position more distant from a recording medium conveyance reference with respect to a direction perpendicular to a recording medium conveyance direction than said first temperature detection element, and a power supply control portion that can execute a first power supply control for controlling power supplied to said heater so that the temperature detected by said first temperature detection element is kept at a set temperature and a second power supply control for controlling power supplied to said heater so that the temperature detected by said second temperature detection element is kept at a set temperature; and a conveyance control portion that controls conveyance of the recording medium, wherein in a case where image forming is performed on the recording medium having a size that covers a position at which said second temperature detection element is disposed with respect to the direction perpendicular to the recording medium conveyance direction, if the temperature detected by said second temperature detection element rises to a predetermined temperature during execution of the first power supply control, said power supply control portion effects switching from the first power supply control to the second power supply control, and in a case where image forming is performed on the recording medium having a size that does not cover the position at which said second temperature detection element is disposed with respect to the direction perpendicular to the recording medium conveyance direction, if the temperature detected by said second temperature detection element rises to a predetermined temperature during execution of the first power supply control, said conveyance control portion executes a control for extending conveyance interval of the recording medium, while said power supply control portion maintains the first power supply control.

Further features of the present invention will become apparent from the following description of exemplary embodiments with reference to the attached drawings.

DESCRIPTION OF THE EMBODIMENTS

In the following, preferred embodiments of the present invention will be described by way of example, with reference to the accompanying drawings.

First Embodiment (1) Exemplary Image Forming Apparatus

Figure 1:
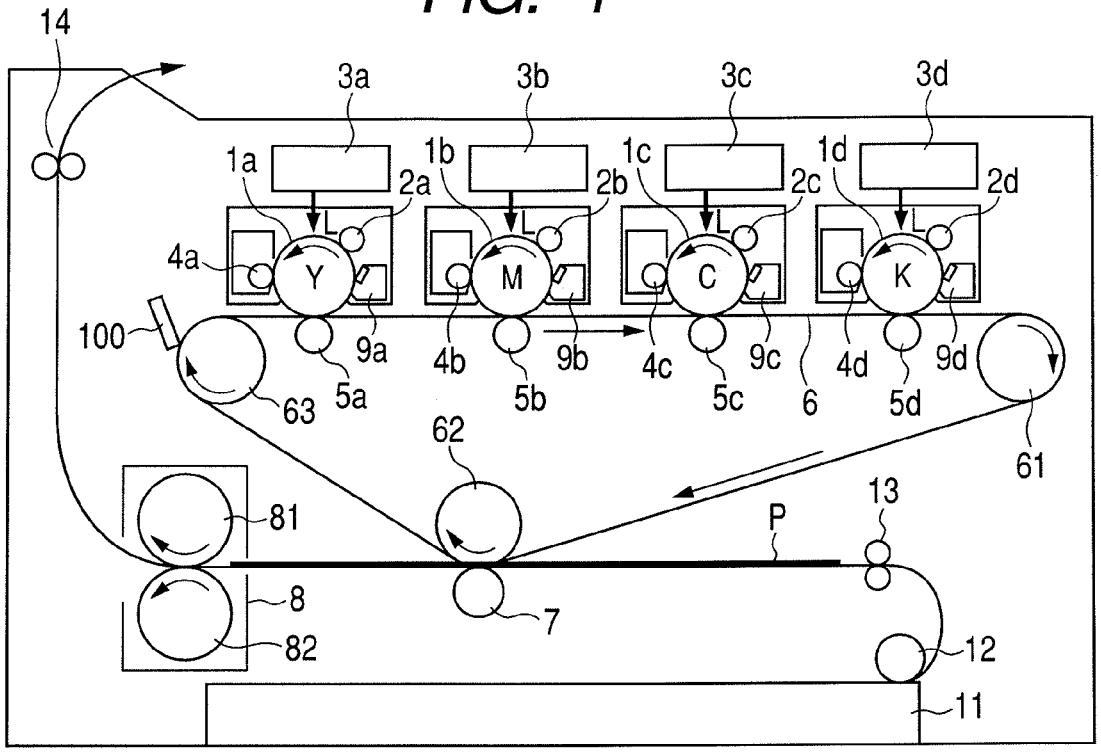
FIG. 1 is a schematic cross sectional view of an image forming apparatus according to the present invention.

FIG. 1 is a schematic diagram showing a color image forming apparatus according to a first embodiment of the present invention. The image forming apparatus according to this embodiment is a tandem type full color printer using an electrophotographic process.

The image forming apparatus is equipped with four image forming sections (or image forming units) including an image forming section Y that forms yellow images, an image forming section M that forms magenta images, an image forming section C that forms cyan images, and an image forming section K that forms black images. These image forming sections are arranged in a line at regular intervals.

The image forming sections Y, M, C and K are provided with photosensitive drums 1*a*, 1*b*, 1*c* and 1*d* respectively. Around each photosensitive drum 1*a*, 1*b*, 1*c*, 1*d* are provided a charge roller 2*a*, 2*b*, 2*c*, 2*d*, a development apparatus 4*a*, 4*b*, 4*c*, 4*d*, a transferring roller 5*a*, 5*b*, 5*c*, 5*d*, and a drum cleaning apparatus 9*a*, 9*b*, 9*c*, 9*d*. At a position above and between the charge roller 2*a*, 2*b*, 2*c*, 2*d* and the development apparatus 4*a*, 4*b*, 4*c*, 4*d* is provided an exposure apparatus 3*a*, 3*b*, 3*c*, 3*d*. The photosensitive drum 1*a*, 1*b*, 1*c*, 1*d* is in contact with the transferring roller 5*a*, 5*b*, 5*c*, 5*d* to form a primary transferring portion (or a primary transfer nip portion). The development apparatuses 4*a*, 4*b*, 4*c* and 4*d* respectively have yellow toner, magenta toner, cyan toner, and black toner stored therein.

An intermediate transfer belt 6 or an intermediate transfer member in the form of an endless belt serving as a transfer medium is in contact with the primary transferring portions of the respective photosensitive drums 1*a*, 1*b*, 1*c* and 1*d* of the image forming sections Y, M, C and K. The intermediate transfer belt 6 is looped around a drive roller 61, a support roller 63 and a secondary transferring opposing roller 62. The intermediate transfer belt is rotated (or driven) by the drive roller 61 in the direction indicated by an arrow (i.e. in the clockwise direction).

Each transferring roller 5*a*, 5*b*, 5*c*, 5*d* for primary transfer abuts each photosensitive drum 1*a*, 1*b*, 1*c*, 1*d* in each primary transfer nip portion via the intermediate transfer belt 6.

The secondary transferring opposing roller 62 abuts the secondary transferring roller 7 via the intermediate transfer belt 6 to form a secondary transfer portion.

A belt cleaning apparatus 100 that removes and collects transfer residual toner remaining on the surface of the intermediate transfer belt 6 is provided in the vicinity of the support roller 63 outside the intermediate transfer belt 6.

A fixing apparatus (or fixing portion) 8 is provided downstream of the secondary transfer portion with respect to the conveyance direction of the recording medium P.

When an image forming operation start signal is generated, the photosensitive drums 1*a*, 1*b*, 1*c*, 1*d*, which are rotated at a specific process speed, in the image forming sections Y, M, C, K are uniformly charged negatively in this embodiment by the charge rollers 2*a*, 2*b*, 2*c*, 2*d* respectively.

The exposure apparatuses 3*a*, 3*b*, 3*c*, 3*d* convert color separated image signals input thereto into light signals respectively in laser emitting portions (not shown). The photosensitive drums 1*a*, 1*b*, 1*c*, 1*d* that have been charged are exposed to or scanned by the respective converted light signals or laser beams L, whereby electrostatic latent images are formed thereon.

Firstly, yellow toner is electrostatically attached to the photosensitive drum 1*a* on which the electrostatic latent image has been formed, in accordance with the charge potential on the surface of the photosensitive member, by the development apparatus 4*a* on which a development bias having polarity the same as the charging polarity of the photosensitive drum 1*a* (i.e. negative polarity) is applied. Thus, the electrostatic latent image is visualized as a developed image. This yellow toner image is primarily transferred in the primary transfer portion onto the rotating intermediate transfer belt 6, by the transferring roller 5*a* on which a primary transfer bias (having polarity reverse to the charge of the toner, i.e. having positive polarity) is applied. The intermediate transfer belt 6 on which the yellow toner image has been formed is rotated in the direction toward the image forming section M.

In the image forming section M also, a magenta toner image formed on the photosensitive drum 1*b* in a similar manner is transferred in the primary transfer portion and superimposed on the yellow toner image on the intermediate transfer belt 6.

Subsequently, a cyan toner image and a black toner image formed on the photosensitive drums 1*c* and 1*d* in the image forming sections C and K are successively superimposed on the yellow and magenta toner images having been transferred on the intermediate transfer belt 6 in a superimposed manner, in the respective primary transfer portions. Thus, a full color toner image is formed on the intermediate transfer belt 6.

In synchronization with timing of arrival of the leading edge of the full color toner image on the intermediate transfer belt 6 at the secondary transfer portion, a recording medium P set in a sheet feeding cassette 11 is introduced into the main body of the apparatus by a feed roller 12 and conveyed to the secondary transfer portion by registration rollers 13. The full color toner image is secondarily transferred onto the recording medium P at one time by the secondary transferring roller 7 on which a secondary transfer bias (having a polarity reverse to the charge of the toner, i.e. having positive polarity) is applied. The recording medium P on which a full color toner image has been formed is conveyed to the fixing apparatus 8, in which the full color toner image is heated and pressurized in the fixing nip portion (or pressure contact portion) between a fixing sleeve 81 and a pressure roller 82, whereby the full color toner image is fused on the surface of the recording medium P. Thereafter, the recording medium P is discharged to the exterior of the full color printer by discharge rollers 14, whereby the output image of the image forming apparatus is provided. Then, a series of image forming operations is terminated.

Primary transfer residual toner remaining on the photosensitive drums 1*a*, 1*b*, 1*c*, 1*d* after the primary transfer process is removed and collected by the drum cleaning apparatuses 9*a*, 9*b*, 9*c*, 9*d*. Secondary transfer residual toner remaining on the intermediate transfer belt 6 after the secondary transfer is removed and collected by the belt cleaning apparatus 100.

(2) Fixing Apparatus (Fixing Portion) 8

Figure 2:
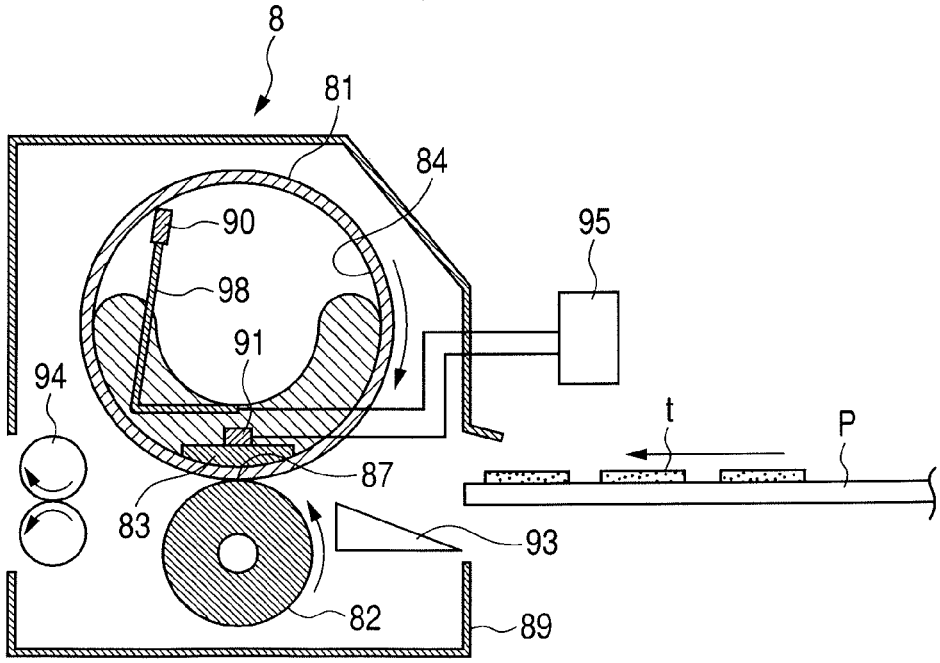
FIG. 2 is a schematic cross sectional view of a fixing apparatus according to the present invention.

FIG. 2 is a diagram schematically showing the structure of the fixing apparatus 8. The fixing apparatus 8 in this embodiment is a heat fixing apparatus using a fixing sleeve heating method.

(I) Overall Configuration of Fixing Apparatus 8

The fixing sleeve (or endless belt) 81 is a cylindrical member produced by providing an elastic layer on a belt-like member. The pressure roller 82 serves as a pressurizing member (or a back-up member). The fixing apparatus 8 also has a heat-resistant, rigid heater holder 84 serving as a heat member holding member having a substantially semi-circular cross section and a heater 83 serving a heat member. The heater 83 is disposed on the bottom surface of the heater holder 84 along the longitudinal direction of the heater holder 84 (i.e. the direction perpendicular to the direction in which recording mediums P are conveyed). The fixing sleeve 81 is loosely fitted outside the heater holder 84.

The heater 83 as the heat member used in this embodiment is a ceramic heater having a substrate made of aluminum nitride and an electrified heat generation resistive layer made of silver and palladium provided thereon. With power supply to electrodes provided at the ends of the electrified heat generation resistive layer, the electrified heat generation resistive layer generates a specific quantity of heat per unit length. The heater holder 84 is made of a liquid crystal polymer resin having a high heat resistance. The heater holder 84 guides the fixing sleeve 81 as well as holds the heater 83. The pressure roller 82 is produced by forming a silicone rubber layer on a metal core by injection molding and covering it with a PFA resin tube. The pressure roller 82 is rotatably supported between front and rear side panels (not shown) of the apparatus frame 89 via bearings by both ends of the metal core. The sleeve unit composed of the heater 83, the heater holder 84, the fixing sleeve 81 etc. is disposed above and in parallel to the pressure roller 82 in such a way that the heater 83 side thereof faces pressure roller 82. Both ends of the heater holder 84 are pressed or biased by a pressing mechanism (not shown) toward the pressure roller 82 by a force of 12.5 kgf (122.5 N) at one end, or 25 kgf (245 N) in total. Thus, a surface of the heater 83 is brought into pressure contact with the elastic layer of the pressure roller 82 via the fixing sleeve 81 against the elasticity of the elastic layer, whereby the fixing nip portion 87 having a predetermined width required to achieve heat fixing is formed. The pressing mechanism has a pressing suspension mechanism, which can suspend pressing, at a time, for example, when paper jam is to be cleared, to facilitate removal of a recording medium(s) P.

Figure 3:
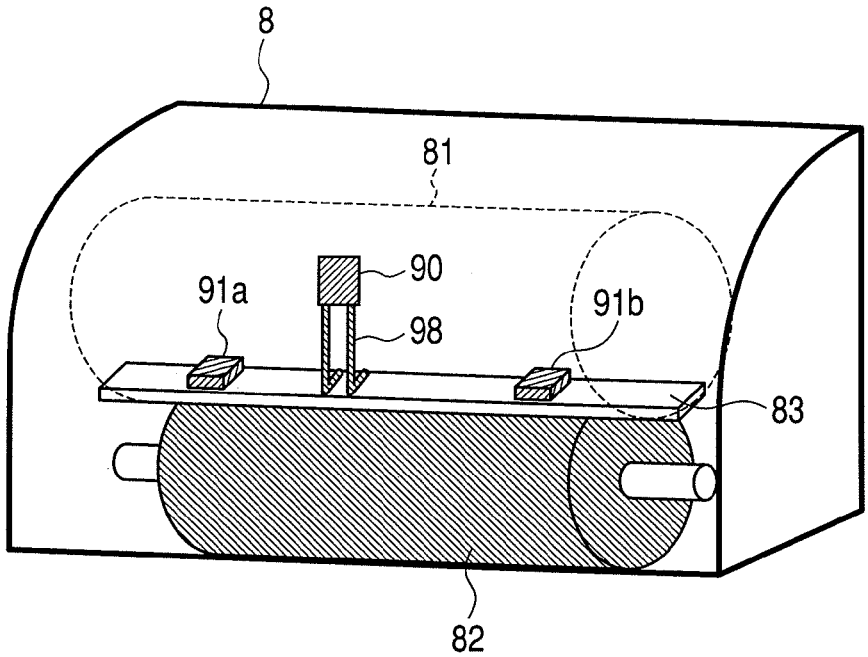
FIG. 3 is a schematic perspective view of the fixing apparatus according to the present invention.

FIG. 3 is a schematic perspective view showing the positional relationship among the heater 83, a main thermistor 90 serving as a first temperature detection element, sub thermistors 91*a* and 91*b* (which are designated simply by numeral 91 in FIG. 2) serving as second temperature detection elements in the fixing apparatus 8 according to this embodiment.

The main thermistor 90 detects the temperature of the heat member or the temperature of the fixing sleeve heated by the heat member. In this embodiment, the main thermistor 90 is adapted to be in elastic contact with the inner surface of the fixing sleeve 81 at a position above the heater holder 84 and detects the temperature of the inner surface of the fixing sleeve 81. The sub thermistors 91*a* and 91*b* detect the temperature of the heat member or the temperature of the fixing sleeve heated by the heat member. In this embodiment, the sub thermistors 91*a* and 91*b* are adapted to be in contact with the surface of the heater 83 that faces upward in FIGS. 2 and 3 (which surface will be hereinafter referred to as the back surface). The sub thermistors 91*a* and 91*b* detect the temperature of the back surface of the heater 83 at the end portions of the heat generation resistive layer.

The main thermistor 90 has a thermistor element attached on an end of a stainless-steel arm 98 fixedly mounted on the heater holder 84. The arm 98 can swing elastically, whereby the thermistor element is continuously kept in contact with the inner surface of the fixing sleeve 81 even in a state in which motion of the inner surface of the fixing sleeve 81 is unstable.

The main thermistor 90 is disposed near the center (which is the recording medium conveyance reference) of the fixing sleeve 81 with respect to the longitudinal direction, and the sub thermistors 91*a* and 91*b* are disposed at positions equidistant from the center of the heater 83 and near the ends thereof. The main thermistor 90 and the sub thermistors 91*a*, 91*b* are adapted to be in contact respectively with the inner surface of the fixing sleeve 81 and the back surface of the heater 83. Thus, the sub thermistors 91*a* and 91*b* detect the temperature at positions more distant from the recording medium conveyance reference with respect to the direction perpendicular to the recording medium conveyance direction than the main thermistor 90.

As shown in FIG. 2, the main thermistor 90 and the sub thermistors 91*a*, 91*b* are connected with a control circuit portion (e.g. CPU) 95. The control circuit portion (or power supply control portion) 95 determines how power is to be supplied to the heater 83 based on detection results of the main thermistor 90 and the sub thermistors 91*a*, 91*b*. An inlet guide 93 and a fixing discharge rollers 94 are mounted on the frame 89 of the apparatus. The inlet guide 93 is adapted to guide the recording medium P coming out of the secondary transfer nip portion precisely into the fixing nip portion 87. The inlet guide 93 used in this embodiment is made of a polyphenylene sulphide (PPS) resin.

The pressure roller 82 is driven by a driving element such as a motor to rotate in the anticlockwise direction as indicated by an arrow at a predetermined peripheral velocity. The driving element is controlled by a conveyance control portion (not shown). A pressure contact frictional force generated between the outer surface of the pressure roller 82 and the fixing sleeve 81 in the fixing nip portion 87 with the rotational drive of the pressure roller 82 exerts a rotational force on the cylindrical fixing sleeve 81. By the effect of this force, the fixing sleeve 81 is driven to rotate in the clockwise direction as indicated by an arrow around the heater holder 84 with the inner surface of the fixing sleeve 81 being in close contact with and sliding on the lower surface of the heater 83. Lubricant grease is applied on the inner surface of the fixing sleeve 81 to ensure sliding between the heater holder 84 and the inner surface of the fixing sleeve 81.

The pressure roller 82 is rotationally driven, whereby the cylindrical fixing sleeve 81 rotates following the rotation of the pressure roller 82. In addition, electrical power is supplied to the heater 83, and the temperature of the heater 83 rises to a predetermined temperature under temperature control. In this state, a recording medium P on which an unfixed toner image t is borne is guided along the inlet guide 93 and introduced into the fixing nip portion 87 between the fixing sleeve 81 and the pressure roller 82. Thus, the surface of the recording medium P on which the toner image is borne contacts the outer surface of the fixing sleeve 81 in the fixing nip portion 87, and the recording medium P is pinched and conveyed in the fixing nip portion 87 with the fixing sleeve 81. In this pinched and conveyed process, the recording medium P receives heat of the heater 83 via the fixing sleeve 81, whereby the unfixed toner image t on the recording medium P is fused on the recording medium by application of heat and pressure. The recording medium P having passed through the fixing nip portion 87 is self-stripped from the fixing sleeve 81 by the difference between curvatures and discharged by the fixing discharge rollers 94.

Figure 4:
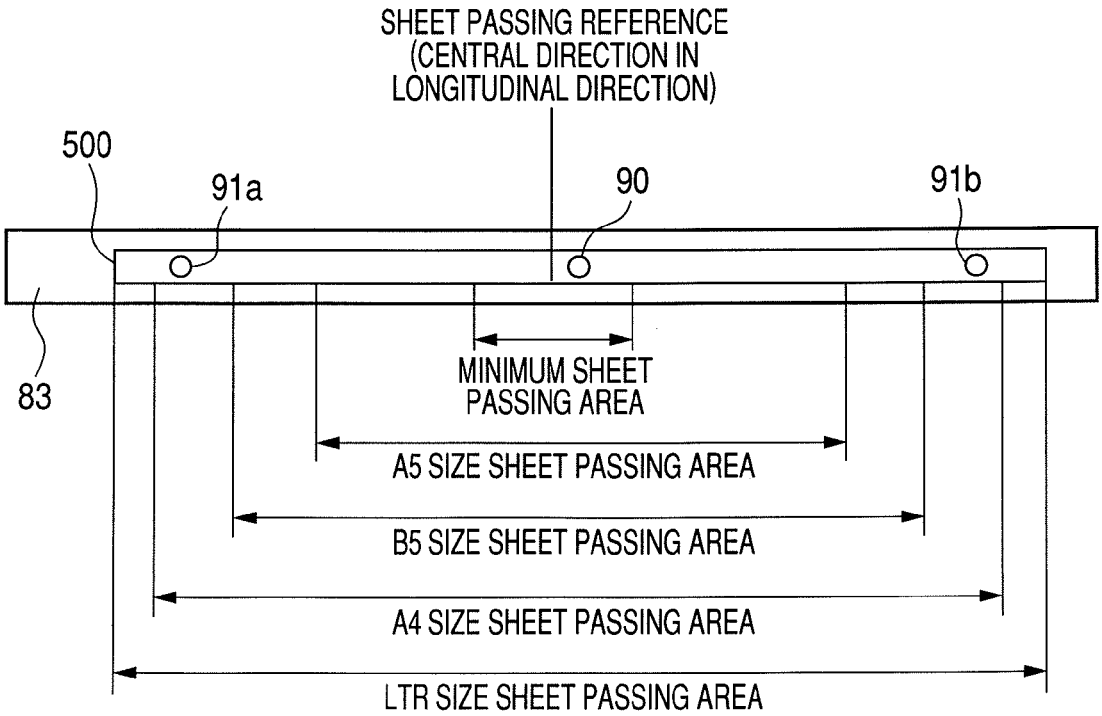
FIG. 4 is a diagram illustrating positional relationship of a heater, a main thermistor, and sub thermistors according to a first embodiment of the present invention.

(II) Relationship With Respect to Longitudinal Direction Among Heater, Temperature Detection Elements, and Sheet-Passing Areas Associated With Recording Mediums of Typical Sizes FIG. 4 shows positional relationship of some components in the fixing nip portion 87 with respect to the longitudinal direction.

The heater 83 has a electrified heat generation resistive layer 500 provided on a substrate.

In the image forming apparatus according to this embodiment, the sheet-passing reference is set as a center reference with respect to the longitudinal direction when conveying the recording medium P. The main thermistor 90 is disposed within the sheet passing area (i.e. the area through which the recording sheet is conveyed) of the recording medium having the least width among the recording mediums that can be passed or fed (namely, disposed within the minimum sheet passing area). The sub thermistors 91*a*, 91*b* in this embodiment are disposed at positions equidistant from the sheet-passing reference and near the ends of and within the sheet passing area of recording mediums of A4 size (or the A4 size sheet passing area) with respect to the longitudinal direction. In other words, the sub thermistors 91*a* and 91*b* are disposed in the non-sheet passing area (or outside the sheet passing area) for recording mediums having a width smaller than the A4 size recording medium, such as B5 and A5 size recording mediums. In the image forming apparatus according to this embodiment, the largest size sheet that can be used is the letter size sheet, whose length along the aforementioned longitudinal direction is larger than that of the A4 sheet.

(3) Fixing Temperature Control

In this section, temperature control in the fixing apparatus 8 will be described.

The image forming apparatus according to this embodiment conveys a recording medium P set in the sheet feeding cassette 11 provided in the lower portion of the apparatus to the secondary transfer portion when forming an image, as shown in FIG. 1. The sheet feeding cassette 11 is provided with a recording medium regulation plates (recording medium size detection elements) that is not shown in the drawings, and the size of the recording mediums set therein can be discriminated (or detected) based on the distance between the recording medium regulation plates.

When an image forming operation start signal is generated, the pressure roller 82 is driven to rotate, whereby the cylindrical fixing sleeve 81 is driven to rotate following the rotation of the pressure roller 82. In addition, power is supplied to the heater 83, whereby the temperature of the heater 83 rises to a predetermined temperature under temperature control. Thereafter, a recording medium P with an unfixed toner image t borne on a surface thereof is introduced and conveyed. During the conveyance, heat of the heater 83 is given to the recording medium P via the fixing sleeve 81, whereby the unfixed toner image t on the recording medium P is fused on the recording medium P by application of heat and pressure.

In the following, temperature control methods used in cases where recording mediums of respective sizes are passed will be described for exemplary cases in which typical sizes of recording mediums are passed.

[1] LTR Size Sheet

As shown in FIG. 4, in this embodiment, the largest sheet that can be passed is the LTR size sheet. Therefore, the length of the electrified heat generation resistive layer 500 of the heater 83 along the longitudinal direction is designed in such a way that good fixability is achieved from one end to the other of the recording medium even when a LTR size recording medium is passed.

In a case where LTR size recording mediums are passed, power supply to the heater 83 is controlled so that the temperature detected by the main thermistor 90 is kept constant, during passing of the recording mediums. In this embodiment, power supply is controlled so that the temperature Tmain 1 detected by the main thermistor 90 is kept equal to a first set temperature (197° C.) (the first power supply control). When a LTR size recording medium is passed, since the sheet passing area extends almost all over the length of the electrified heat generation resistive layer 500 of the heater 83 with respect to the longitudinal direction as shown in FIG. 4, the non-sheet passing portion temperature rise described before does not occur. Therefore, although the sub thermistors 91*a* and 91*b* continuously detect the temperature of the heater 83, they do not play a direct role in the power supply control for the heater 83, unless abnormal temperature is detected. Thus, while a LTR size recording medium passes, the power supply control for keeping a temperature of 197° C. is continuously carried out using the main thermistor 90.

[2] A4 Size Sheet

As shown in FIG. 4, in this embodiment, in a case where A4 size recording mediums are passed, the sub thermistors 91*a* and 91*b* are located at positions near the ends of but within the sheet passing area, while the main thermistor 90 is located at the central portion of the sheet passing area. Specifically, the sub thermistors 91*a* and 91*b* are located at positions 99 mm (ninety-nine millimeters) away from the sheet-passing reference in opposite (or left and right) horizontal directions toward the ends with respect to the longitudinal direction, namely at positions 6 mm (six millimeters) inside the edges of the A4 size recording medium. In addition, since the length of the electrified heat generation resistive layer 500 of the heater 83 is longer than the width of the recording medium, there are so-called non-sheet passing portions.

In a case where A4 size recording mediums are passed, at the beginning of sheet passing, power supply is also controlled so that the temperature Tmain1 detected by the main thermistor 90 is kept equal to the first set temperature (197° C.), as is the case during passing of LTR size recording mediums. During this, the sub thermistors 91*a*, 91*b* continue to monitor temperature, though they do not play any role in the power control.

As successive passing of recording mediums continues, the temperature detected by the sub thermistors 91*a*, 91*b*, which detect the temperature at the end portions of the sheet passing area with respect to the longitudinal direction, gradually rises due to influence of a temperature rise in the non-sheet passing portion in which recording mediums do not pass, while the power supply control that keeps constant the temperature detected by the main thermistor 90 disposed at the central portion of the sheet passing area is performed.

Figure 5A:
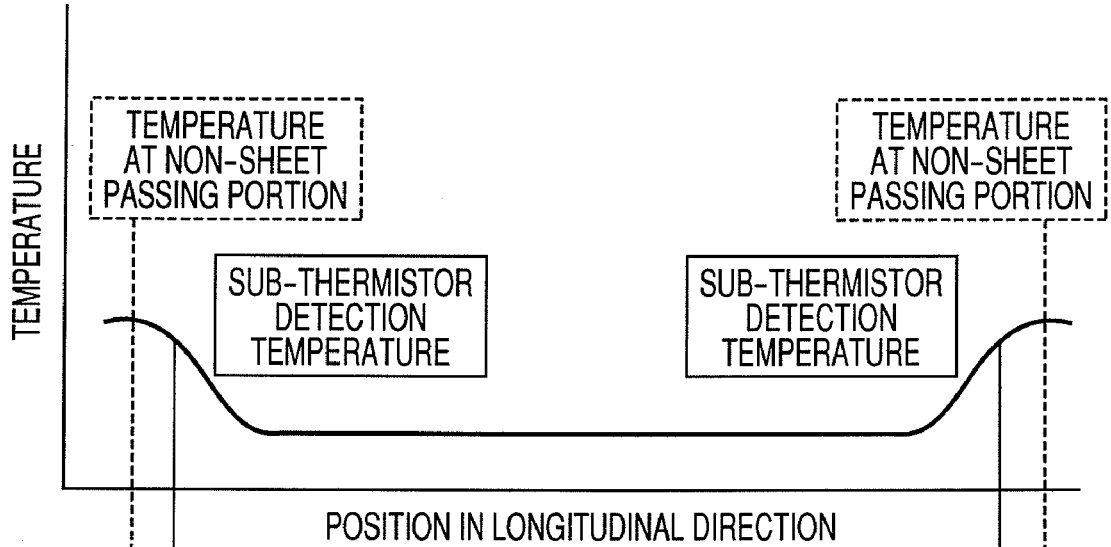
FIG. 5A is a schematic graphic illustration of a temperature distribution along an longitudinal direction at a time when an A4 size recording medium is passing in the first embodiment of the present invention.
Figure 5B:
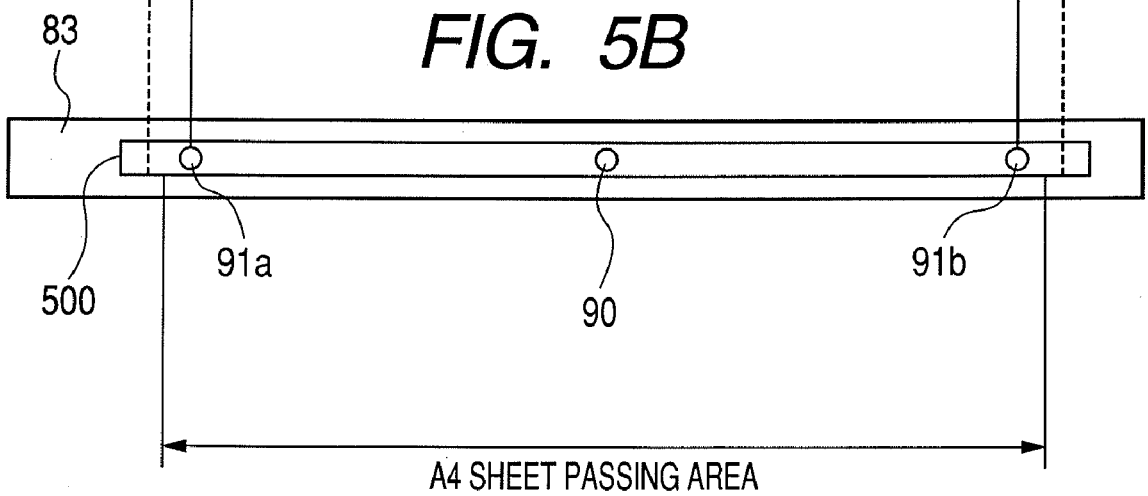
FIG. 5B is a diagram illustrating positional relationship of the heater, the main thermistor, and the sub thermistors in association with FIG. 5A.

As shown in FIG. 4, the sub thermistors 91*a*, 91*b* are disposed at positions 6 mm inside the edges of the A4 size recording medium with respect to the longitudinal direction, namely, located within the sheet passing area. However, the temperature of the non-sheet passing portions of the heater located outside the edges of the recording medium with respect to the longitudinal direction becomes very high, and heat in these non-sheet passing portions is transferred on and in the substrate of the heater to reach the positions of the sub thermistors 91*a*, 91*b*. For this reason, the temperature at the positions of the sub thermistors 91*a*, 91*b* tends to become higher than the longitudinal central position at which the main thermistor 90 is disposed. FIGS. 5A and 5B schematically show the temperature distribution of the heater 83 along the longitudinal direction in a state in which the non-sheet passing portion temperature rise is occurring. FIG. 5A shows the temperature distribution along the longitudinal direction of the heater 83. FIG. 5B shows the heater 83 corresponding to FIG. 5A. FIG. 5A is presented in association with FIG. 5B.

When the temperature detected by the sub thermistors 91*a* and 91*b* reaches a predetermined temperature (270° C., in this embodiment), it is determined that the temperature of the non-sheet passing portion is high. Then, the temperature control is switched from the temperature control based on the temperature detected by the main thermistor 90 (power supply control 1, or the first power supply control) into a temperature control for keeping constant the temperature Tsub detected by the sub thermistor 91*a* or the sub thermistor 91*b* (power supply control 2, or the second power supply control). In this embodiment, the second set temperature Tsub is set to 270° C. (namely, the second set temperature is higher than the first set temperature). This temperature is selected so that the temperature at the non-sheet passing portion does not cause thermal damage to the fixing sleeve 81 or other fixing components as long as the temperature detected by the sub thermistor 91*a*, 91*b* located at the end portion of the sheet passing area is kept at the aforementioned temperature. As described above, in a case where an image is to be formed on a recording medium having a size that covers the positions at which the sub thermistors are disposed with respect to the direction perpendicular to the recording medium conveyance direction, if the temperature detected by the sub thermistor rises to the predetermined temperature while power supply control 1 (the first power supply control) is performed, the control circuit portion 95 effects switching from power supply control 1 to power supply control 2 (the second power supply control).

Figure 6:
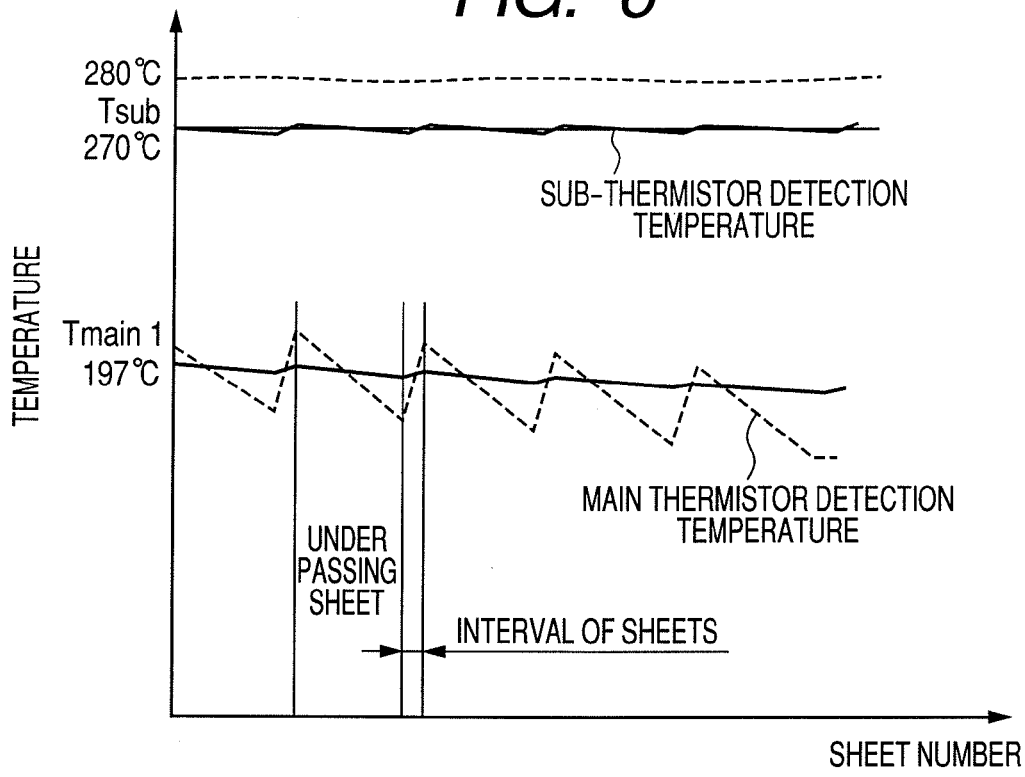
FIG. 6 is a graphic illustration of relationship between the number of passed sheets and temperature in the first embodiment of the present invention.

After switching from power supply control 1 using the main thermistor 90 to power supply control 2 using the sub thermistor 91*a*, 91*b*, a control is performed in such a way as to keep constant the temperature at the end portion of the sheet passing area, at which the temperature tends to become higher than the central portion of the sheet passing area due to the influence of the non-sheet passing portion temperature rise. Consequently, the temperature at the central portion of the sheet passing area gradually falls. However, the fall in the temperature at the central portion of the sheet passing area can be made sufficiently smaller as compared to cases where a control for keeping constant the temperature at a portion in the non-sheet passing portion is performed as is the case with conventional methods. Since the control for keeping constant the temperature at a portion within the sheet passing area is performed, though the portion is the end portion thereof, the fall in the temperature at the central portion of the sheet passing area during passing of one recording medium sheet can be made sufficiently small. FIG. 6 shows changes in the temperature in relation to the number of passing sheets in a case where A4 size recording mediums are passed. FIG. 6 shows the temperature at the central portion of the sheet passing area and the temperature detected by the sub thermistor, in a case where a control for keeping constant the temperature at a non-sheet passing portion in a manner similar to the prior art method (shown by broken lines) and in a case where a control for keeping constant the temperature at the end portion of the sheet passing area is performed in the apparatus according to this embodiment (shown by solid lines). Here, as an apparatus that performs the control for keeping constant the temperature at the non-sheet passing portion in a similar manner as the prior art is supposed, by way of example, to be an apparatus in which a sub thermistor is provided in the non-sheet passing portion. In the case where the sub thermistor is provided in the non-sheet passing portion, the corresponding temperature at the non-sheet passing portion in the situation in which the temperature detected by the sub thermistor 91*a*, 91*b* provided at the position same as the apparatus according to this embodiment is 270° C. is 280° C. Therefore, a control for keeping a constant temperature of 280° C. is performed in comparison.

Figure 8:
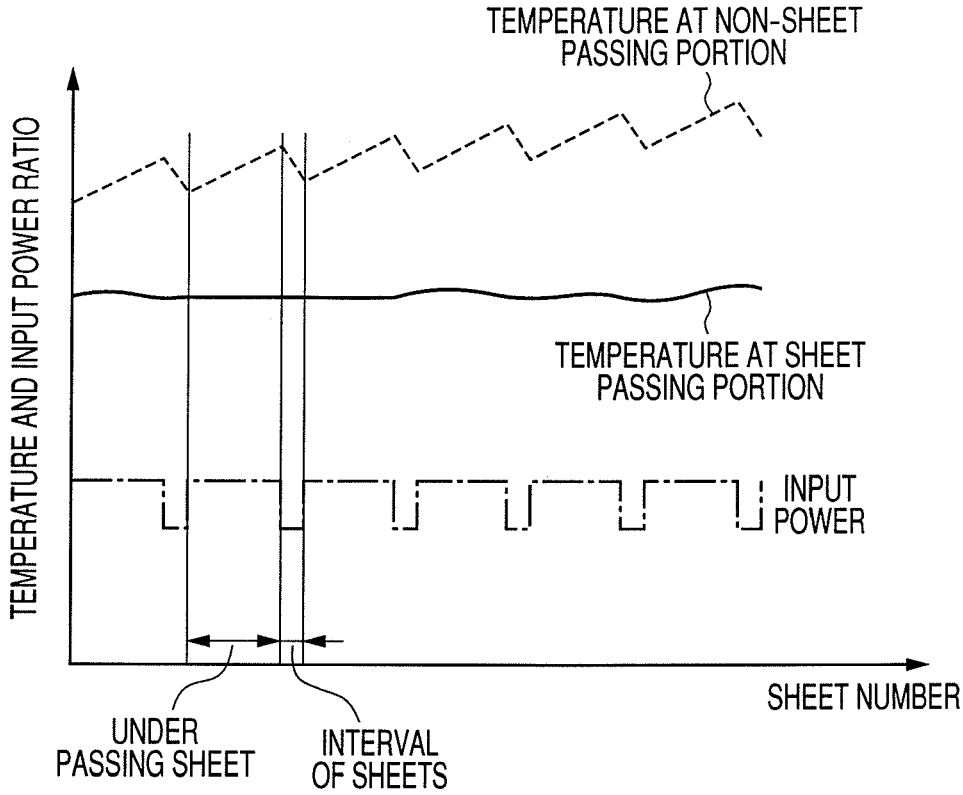
FIG. 8 is a graphic illustration of temperature changes at a sheet passing portion during a power supply control according to a prior art.
Figure 9:
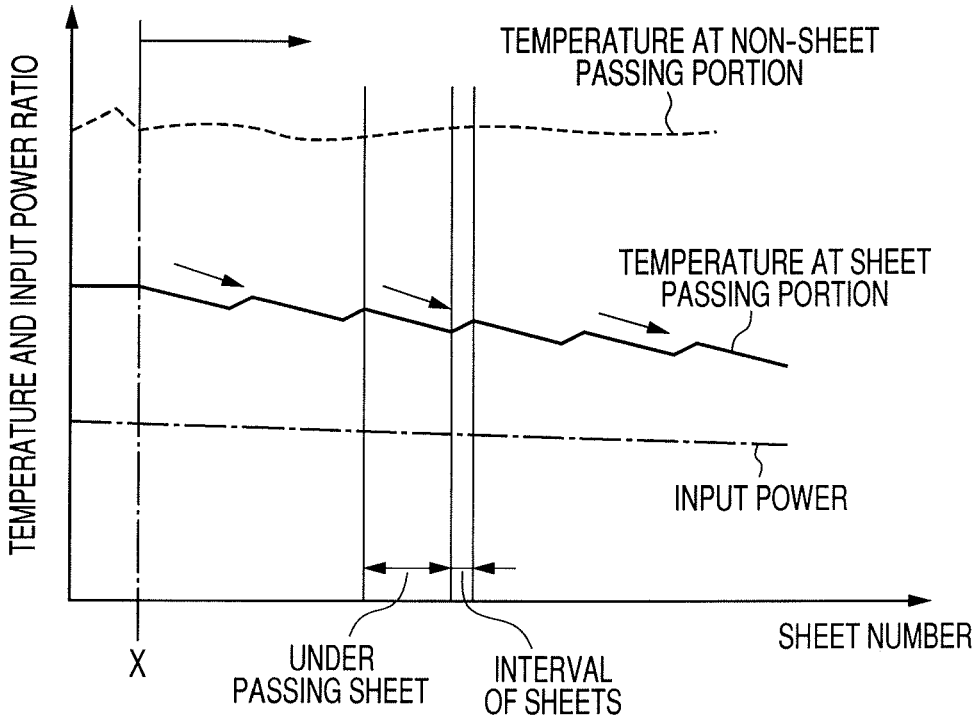
FIG. 9 is a graphic illustration of temperature changes at a non-sheet passing portion during the power supply control according to the prior art.

As described before, in the case of the control for keeping constant the temperature at the central portion of the sheet passing area (power supply control 1), the power supply to the heater 83 is controlled in such a way as to compensate the quantity of heat carried away by the recording mediums. Therefore, the power supply control is performed in such a way that the power supplied to the heater is made larger during sheet passing, and made smaller during sheet interval. FIG. 8 shows the temperature and the input power ratio versus the number of passing sheets in a case where a control for keeping the temperature at the sheet passing portion constant is performed. In contrast to this, in a case where a conventional temperature control for keeping the temperature at the non-sheet passing portion constant as shown by the broken lines in FIG. 6, since the temperature at the portion through which recording mediums never pass is kept constant, the power supplied to the heater is controlled to be substantially constant with no significant difference between the power during sheet passing and the power during sheet interval. In consequence, in the sheet passing area through which recoding materials pass, the temperature rises during a sheet interval after a (preceding) recording medium has passed. Thus, the temperature is high at the time when the leading edge of the succeeding recording medium is passing, and the temperature decreases until the trailing edge of the recording medium passes, because heat is carried away by the recording sheet. This means that the quantity of heat that can be supplied to a recording medium decreases from the leading edge toward the trailing edge thereof. Thus, the quantity of heat that is given to one sheet of recording medium becomes smaller, and therefore deterioration of the image such as glossy unevenness is likely to occur at the leading edge and the trailing edge.

In contrast to the above described conventional temperature control that keeps constant the temperature at the non-sheet passing portion, in a case where the temperature control is performed in such a way as to keep constant the temperature at the end portion of the sheet passing area, as is the case with power supply control 2 in this embodiment shown by the solid in FIG. 6, the situation will be as follows. Since a temperature control for keeping constant the temperature at a portion within the sheet passing area is performed, though the portion is the end portion thereof, a control having effects substantially the same as power supply control 1 is achieved, namely the power supply is made larger during sheet passing to compensate the quantity of heat carried away by the recording medium, and the power supply is made smaller during sheet interval.

As a result, the temperature detected by the main thermistor 90 disposed at the central portion of the sheet passing area and the temperature detected by the sub thermistors 91*a*, 91*b* change in similar manners. Specifically, the temperature detected by the main thermistor 90 does not fall greatly in one sheet of recording sheet, and it will be understood that a fall of the temperature at the central portion of the sheet passing area through passing of the recording area from the leading edge to the trailing edge can be made small.

In recent years, to achieve high speed printing, toner has been improved to have a lower fusing point. For this reason, although the toner can be easily fused and fixed at a relatively low temperature, the range of temperatures that do not cause hot offset while enabling satisfactory quality of fixing has become very narrow. Therefore, a temperature drop in one sheet of recording medium in a state where the temperature of the sheet passing area is controlled so that hot offset does not occur has been tending to affect the fixability detrimentally. Thus, it has become difficult for conventional control methods that keep constant the temperature at the non-sheet passing portion to realize a control of temperature within a temperature range in which both satisfactory fixability and prevention of hot offset are achieved.

In a case where the sub thermistors 91*a*, 91*b* are arranged in the positional relationship according to this embodiment, when, for example, A4 size recording mediums having a basis weight of 80 g/m$^2$ are successively passed, the temperature detected by the main thermistor 90 drops little in one sheet during power supply control 2. The temperature drop during power supply control 2 falls within substantially the same range as a ripple of temperature detected by the main thermistor during power supply control 1. If, for example, a sub thermistor is disposed at a position in the non-sheet passing portion 3 mm away from the edge of the A4 size recording medium, the temperature detected by the main thermistor 90 drops approximately by 5° C. in one sheet when the recording mediums of the aforementioned size are successively passed. If there is a temperature difference of 5° C. between the leading edge and the trailing edge of a recording medium, glossy unevenness will occur in the sheet. If a control that prevents a temperature difference along the sheet passing direction in a sheet is performed as with this embodiment, deterioration in the image quality such as glossy unevenness is prevented. In addition, satisfactory fixability is ensured.

[3] B5, A5 Size Recording Medium

When recording mediums with a small width (which will be hereinafter referred to as a small size sheet), such as B5 or A5 size sheets, are passed, the sub thermistors 91*a*, 91*b* are located at positions in the non-sheet passing portion. In a case where small size recording mediums are passed, power supply is controlled so that the temperature Tmain1 detected by the main thermistor 90 is kept at the first set temperature (197° C.), in a similar manner as the a case where LTR size recording mediums are passed. During this, the sub thermistors 91*a*, 91*b* continue to monitor temperature, though they do not play any role in the power control.

As successive passing of small size recording mediums continues, the temperature detected by the sub thermistors 91*a*, 91*b*, which detect the temperature at the non-sheet passing portion, steeply rise while the power supply control for keeping constant the temperature detected by the main thermistor 90 disposed at the central portion of the sheet passing area is performed, because heat is not carried away by the recording mediums in the non-sheet passing portion.

In this state, if the power supply control is switched to a control that keeps constant the temperature detected by the sub thermistors 91*a*, 91*b* as described in the previous section "[2] A4 Size Sheet", a situation similar to that in the prior art will occur. Specifically, the temperature in the sheet passing area steeply falls during passing of one sheet, which sometimes causes an image quality problem such as glossy unevenness, as described above.

In view of this, in a case where small size recording mediums are passed (i.e. in a case where images are formed on recording mediums having a size that does not extend to or cover the positions at which the sub thermistors are disposed with respect to the direction perpendicular to the recording medium conveyance direction), if the temperature detected by the sub thermistors 91*a*, 91*b* reaches a predetermined temperature (240° C., in this embodiment), the sheet interval time is elongated to decrease the throughput (i.e. a control for extending intervals of conveyed recording mediums is executed by the conveyance control portion) without switching the power supply control to a control using the sub thermistors 91*a*, 91*b* (namely, with power supply control 1 being maintained), to thereby prevent an unduly large rise in the temperature at the non-sheet passing portion.

As described above, an unduly large temperature rise at non-sheet passing portion is prevented from occurring by switching over the thermistors used as temperature detection elements in the power supply control according to the size of the recording mediums detected by the recording medium size detection elements, or by intentionally not-changing the thermistors. Thus, there can be provided an image forming apparatus in which image quality deterioration such as glossy unevenness caused upon switching of the thermistors used in the power supply control can be prevented.

In this embodiment, the size of the recording medium is detected based on the distance between the recording medium regulation plates (recording size detection elements) provided in the sheet feeding cassette 11, as described before by way of example. However, the way of detecting the recording medium size is not limited to this. Besides the method according to this embodiment, the recording medium size may be detected based on recording medium size information selectively entered by a user, or by sensing the area over which the recording medium passes during conveyance of the recording medium using a sensor or the like provided upstream of the fixing apparatus.

Although in this embodiment, the predetermined temperature of 270° C. mentioned in the section describing image formation on the A4 size sheet (i.e. the reference temperature for switching from power supply control 1 to power supply control 2) is different from the predetermined temperature of 240° C. mentioned in the section describing image formation on the B5 (or A5) size sheet (i.e. the reference temperature for starting to decrease the throughput) are different, they may be the same temperature. Although in this embodiment, all of the first set temperature in the fixing process for the letter size sheet, the first set temperature in the fixing process for the A4 size sheet, and the first set in the fixing process for the B5 (or A5) size sheet are the same (i.e. 197° C.), they may be different from each other.

Figure 10:
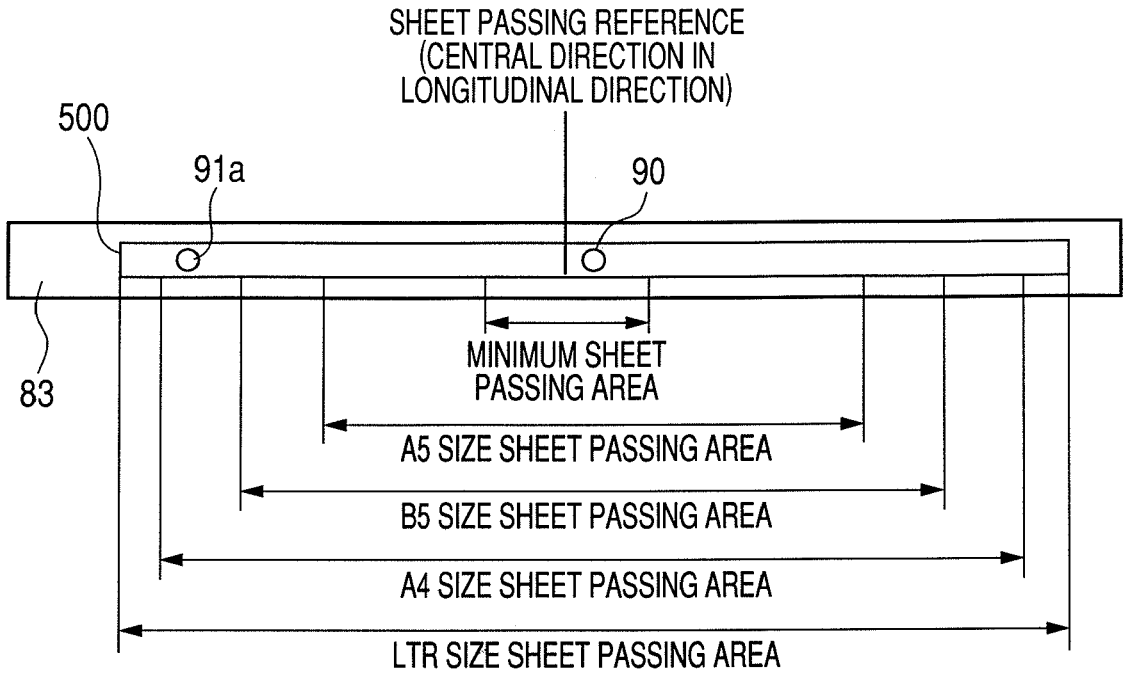
FIG. 10 is a diagram illustrating positional relationship of a heater, a main thermistor, and sub thermistors according to the first embodiment of the present invention.

In this embodiment, the sub thermistors 91*a* and 91*b* are disposed at positions 99 mm away from the sheet-passing reference in opposite (or left and right) directions toward the ends with respect to the longitudinal direction. This is intended to enable a control that keeps constant the temperature detected by the sub thermistors based on the temperature detected by the right sub thermistor or the temperature detected by the left sub thermistor, whichever is the higher, in a case where the heat generation distribution of the heater 83 is not completely uniform along the longitudinal direction. For example, a recording medium displaced from the sheet passing reference during passing makes one of the sub thermistors 91*a*, 91*b* closer to the boundary adjacent to the non-sheet passing portion than the other, and therefore the sub thermistor closer to the boundary can be affected more strongly by the temperature rise at the non-sheet passing portion. If the power supply control is performed based on the temperature detected by the left sub thermistor or the temperature detected by the right sub thermistors, whichever is the higher, the power supply control is performed using the sub thermistor that is strongly affected by the temperature rise at the non-sheet passing portion. Therefore, more effective control of the non-sheet passing portion temperature rise can be achieved. To control the non-sheet passing portion temperature rise, which is the main object of the present invention, it is not necessarily required to provide sub thermistors on both sides of the sheet-passing reference in the directions toward both longitudinal ends (or on the left and right sides of the sheet-passing reference). Similar advantageous effects can also be achieved by, for example, providing a sub thermistor 91*a* on one side of the sheet-passing reference in the direction toward an longitudinal end, as shown in FIG. 10. In the case shown in FIG. 4, similar advantageous effects can be achieved by providing only one of the sub thermistors 91*a* and 91*b*.

Figure 11:
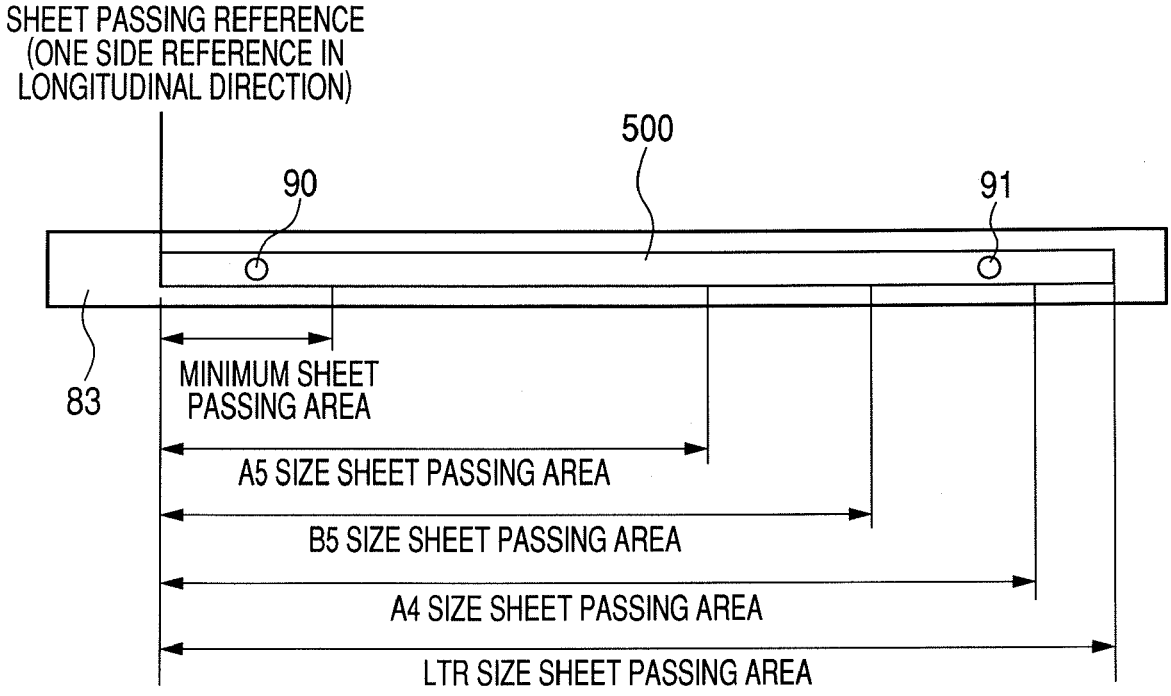
FIG. 11 is a diagram illustrating positional relationship of a recording medium passing area, a heater, a main thermistor, and sub thermistors according to the first embodiment of the present invention.

In the above described embodiment, the sheet-passing reference for recording mediums is at the center. However, even in a case where the sheet-passing reference is at a side, advantageous effects similar to the above described embodiment can also be achieved by providing a sub thermistor 91 at the position shown in FIG. 11, namely at the end portion of the sheet passing area of the A4 size recording medium.

Second Embodiment

By providing two or more second temperature detection elements at different positions relative to the sheet-passing reference with respect to the longitudinal direction, positional relationship similar to the positional relationship of the second temperature detection elements and the A4 size recording sheet in the first embodiment can also be achieved for the B5 and A4 size recording mediums that have smaller widths than the A4 size recording medium.

Figure 7:
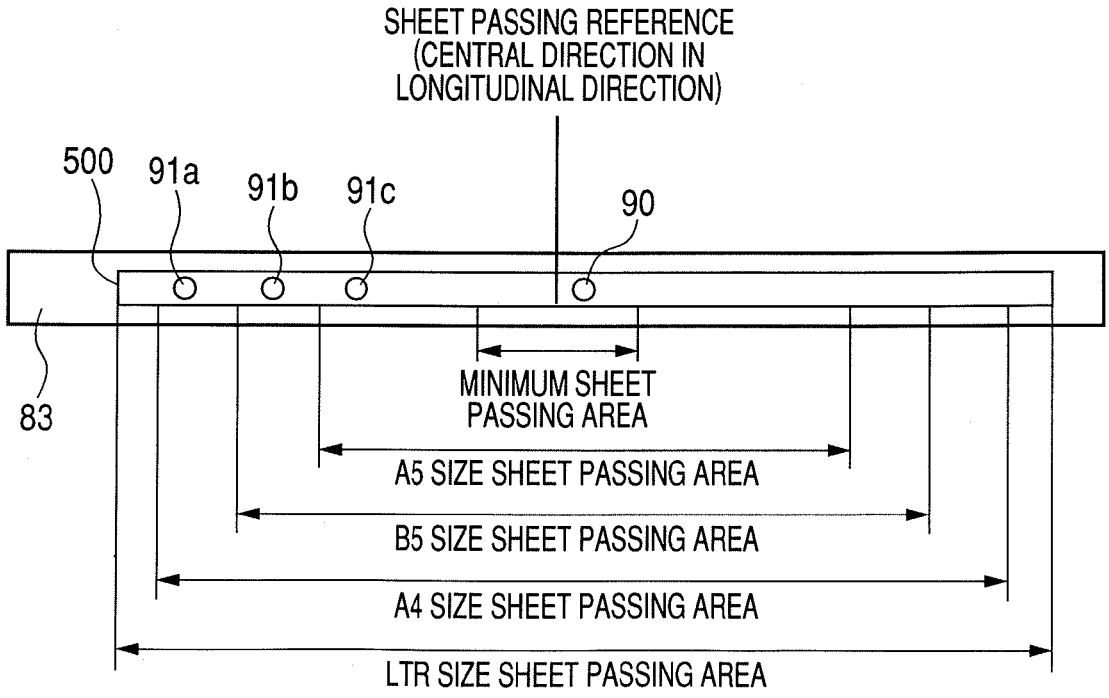
FIG. 7 is a diagram illustrating positional relationship of a heater, a main thermistor, and sub thermistors according to a second embodiment of the present invention.

FIG. 7 shows an arrangement in which a plurality of sub thermistors serving as the second temperature detection elements are provided at different positions relative to the sheet-passing reference with respect to the longitudinal direction.

In this embodiment, a sub thermistor 91*a* is provided at a position that is at the end portion of the sheet passing area for the A4 size recording medium and in the non-sheet passing portion for the B5 size recording medium. Furthermore, a sub thermistor 91*b* is provided at a position that is at the end portion of the sheet passing area for the B5 size recording medium and in the non-sheet passing portion for the A5 size recording medium. Still further, a sub thermistor 91*c* is provided at a position that is at the end portion of the sheet passing area for the A5 size recording medium and in the non-sheet passing portion for the recording medium having the smallest width that can be passed.

In this embodiment, in a case where LTR recording mediums are passed, the control same as that in the first embodiment is also performed.

In a case where A4 size recording mediums are passed, power supply control 1 using the main thermistor 90 is performed at the beginning of sheet passing as is the case with the first embodiment, and when the temperature detected by the sub thermistor 91*a* reaches a predetermined temperature during successive sheet passing, the power supply is switched to power supply control 2 using the sub thermistor 91*a*.

This embodiment is characterized in that power supply control 2 using the sub thermistor 91*a* or 91*b* is performed also in a case where B5 size and A5 size recording sheets are passed. As shown in FIG. 7, the sub thermistor 91*b* is disposed at the end portion of the sheet passing area of the B5 size recording medium, and the sub thermistor 91*c* is disposed at the end portion of the sheet passing area of the A5 size recording medium. Thus, when the temperature detected by the sub thermistor 91*b* (in the case of the B5 size recording medium) or the temperature detected by the sub thermistor 91*c* (in the case of the A5 size recording medium) reaches a predetermined temperature while power supply control 1 using the main thermistor 90 is performed during successive sheet feeding, the power supply control is changed to power supply control 2 that keeps constant the temperature detected by the sub thermistor 91*b* (in the case of the B5 size recording medium) or the temperature detected by the sub thermistor 91*c* (in the case of the A5 size recording medium).

Furthermore, in a case where recording mediums like small size envelopes for which the sub thermistor 91*c* are also located in the non-sheet passing portion are passed, switching from power supply control 1 to power supply control 2 is not effected. In this case, at the time when the temperature detected by the sub thermistor 91*c* reaches a predetermined temperature, the throughput is decreased to prevent the non-sheet passing portion temperature rise.

As described above, in this embodiment a plurality of second temperature detection elements are provided at positions spaced by different distances from the recording medium conveyance reference. The detected temperature that is compared with a predetermined temperature to start power supply control 2 (the second power supply control) is the temperature detected by the second temperature detection element that is located closest to the end of but within the area through which recording mediums pass, among the plurality of second temperature detection elements. For example, in a case where image forming is performed on A4 size recording mediums, what is compared with the predetermined temperature is the temperature detected by not the sub thermistors 91*b* or 91*c* but the sub thermistor 91*a* that is located at the end portion within the area through which A4 size recording mediums pass. In a case where image forming is performed on B5 size recording mediums, what is compared with the predetermined temperature is the temperature detected by not the sub thermistors 91*a* or 91*c* but the sub thermistor 91*b* that is located at the end portion within the area through which B5 size recording mediums pass.

By providing two or more sub thermistors serving as the second temperature detection elements at different positions relative to the sheet-passing reference as with this embodiment, temperature at the end portion of the sheet passing area can be detected for various sizes of recording mediums. Thus, an unduly large temperature rise in the non-sheet passing portion can be prevented from occurring for various sizes of recording mediums, and in addition deterioration of image quality caused by switching of the mode of power supply control can be eliminated.

Third Embodiment

After switching from the temperature control based on the temperature detected by the main thermistor 90 serving as the first temperature detection element (power supply control 1) to the temperature control based on the temperature detected by the sub thermistor(s) 91*a* etc. serving as the second temperature detection element (power supply control 2), the situation that has been described in conjunction with the first embodiment will occur. Specifically, the temperature at the central portion of the sheet passing area falls gradually. Although the fall of the temperature at the central portion of the sheet passing area can be made minimum by providing sub thermistor(s) 91*a* etc. at the end portion of the sheet passing area in a manner similar to the present invention, if a large number of sheets are successively passed, the temperature at the central portion of the sheet passing area falls to a temperature at which fixing error is caused, in some cases.

To prevent this problem, in this embodiment, the following control is performed. For the sake of simplicity, a case where A4 size recording mediums are passed will be described.

In the case of this embodiment also, at the beginning of printing, power supply is controlled so that the temperature of the main thermistor 90 serving as the first temperature detection element is kept at Tmain1 (power supply control 1), where Tmain1 is the target temperature control value of the main thermistor 90. In this state, at the time when the temperature detected by the sub thermistor 91*a* located at the end portion of the sheet passing area of the passing recording mediums reaches a predetermined temperature Tsub, the temperature control is switched to a control for keeping the temperature detected by the sub thermistor 91*a* at T1 (power supply control 2). During power supply control 2, the main thermistor 90 continues to monitor temperature, though it does not play any role in the power control.

If a large number of sheets are successively passed thereafter, the temperature at the central portion of the sheet passing area falls as described above. When successive sheet passing has been performed, the pressure roller 82 has received heat during sheet intervals, and the temperature of the pressure roller 82 has become so higher than the temperature at the beginning of the successive sheet passing that a state that enables fixing can be maintained even if the temperature detected by the main thermistor 90 at the central portion of the sheet passing area has fallen to some extent. However, if the fall of the temperature becomes larger than a certain value, the fixability cannot be maintained any longer. To avoid such deterioration of fixability, if the temperature detected by the main thermistor 90 that continues temperature monitoring decreases to Tmain2 (the second predetermined temperature) that is lower than Tmain1, the sheet passing interval of the next recording medium is extended to reduce the throughput. In addition, the power supply control is switched again to the control for keeping constant the temperature detected by the main thermistor 90 (i.e. main temperature control (or power supply control 1). The target temperature Tmain3 of the main temperature control after the throughput reduction may be set lower than Tmain1. In this embodiment, the temperature values are set as follows: Tmain1=197° C., Tmain2=190° C., Tmain3=185° C., and Tsub=270° C. The temperature Tmain2 is the lowest temperature that is needed to maintain fixation of toner images on recording mediums that are passed at the initial printing speed.

By performing the above described control, an unduly large temperature rise at the non-sheet passing portion can be prevented from occurring and images with good fixation quality can be provided, even in a case where a large number of sheets are successively printed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-028770, filed Feb. 8, 2008, which is hereby incorporated by reference herein in its entirety.

What is claimed is:

1. An image forming apparatus for forming an image on a recording medium, comprising:

an image forming portion that forms an image on the recording medium;

a fixing portion that heats the image formed on the recording medium to fix the image on the recording medium, the fixing portion including an endless belt that is in contact with the recording medium, a heater that is in contact with an inner circumferential surface of said endless belt, a back-up member that forms, in cooperation with said heater, a fixing nip portion that pinches and conveys the recording medium via said endless belt, a first temperature detection element that detects a temperature of said heater or a temperature of said endless belt, a second temperature detection element that detects a temperature of said heater or a temperature of said endless belt at a position more distant from a recording medium conveyance reference with respect to a direction perpendicular to a recording medium conveyance direction than said first temperature detection element, and a power supply control portion that can execute a first power supply control for controlling power supplied to said heater so that the temperature detected by said first temperature detection element is kept at a set temperature and a second power supply control for controlling power supplied to said heater so that the temperature detected by said second temperature detection element is kept at a set temperature; and a conveyance control portion that controls conveyance of the recording medium, wherein in a case where image forming is performed on the recording medium having a size that covers a position at which said second temperature detection element is disposed with respect to the direction perpendicular to the recording medium conveyance direction, if the temperature detected by said second temperature detection element rises to a predetermined temperature during execution of the first power supply control, said power supply control portion effects switching from the first power supply control to the second power supply control, and in a case where image forming is performed on the recording medium having a size that does not cover the position at which said second temperature detection element is disposed with respect to the direction perpendicular to the recording medium conveyance direction, if the temperature detected by said second temperature detection element rises to a predetermined temperature during execution of the first power supply control, said conveyance control portion executes a control for extending conveyance interval of the recording medium, while said power supply control portion maintains the first power supply control.

2. An image forming apparatus according to claim 1, wherein a plurality of said second temperature detection elements are provided at positions at different distances from the conveyance reference, wherein the detected temperature detected by said second temperature detection element is to be compared with the set temperature when the second power supply control is executed, wherein the detected temperature compared with the set temperature when the second power supply control is executed includes a temperature detected by said second temperature detection element that is located closest to an end of and within an area through which the recording medium passes among the plurality of said second temperature detection elements.

3. An image forming apparatus according to claim 1, wherein when the temperature detected by said first temperature detection element decreases to a second predetermined temperature after said power supply control portion has effected switching from the first power supply control to the second power supply control, said power supply control portion effects switching from the second power supply control back to the first power supply control.

* * * * *